US007963405B2

(12) United States Patent
Chiang et al.

(10) Patent No.: US 7,963,405 B2
(45) Date of Patent: Jun. 21, 2011

(54) SHOE RACK

(76) Inventors: Hsiao-Hung Chiang, Xinbei (TW); Li-Chi Chu, Xinbei (TW)

( * ) Notice: Subject to any disclaimer, the term of this patent is extended or adjusted under 35 U.S.C. 154(b) by 0 days.

(21) Appl. No.: 12/972,503

(22) Filed: Dec. 19, 2010

(65) Prior Publication Data

US 2011/0084036 A1 Apr. 14, 2011

Related U.S. Application Data

(62) Division of application No. 12/037,947, filed on Feb. 27, 2008, now Pat. No. 7,861,870.

(51) Int. Cl.
*A47F 7/08* (2006.01)

(52) U.S. Cl. ..... 211/37

(58) Field of Classification Search ..... 211/37, 211/34, 36, 163, 196, 193, 205, 107, 70, 211/78, 95, 87.01, 96, 90.01, 197, 59.2, 186, 211/187, 190, 94.01, 103; 108/149, 141, 108/94–96, 108
See application file for complete search history.

(56) References Cited

U.S. PATENT DOCUMENTS 1,238,275 A * 8/1917 Deeley ..... 211/36
1,589,198 A * 6/1926 McComb ..... 211/150
1,710,940 A * 4/1929 Murphy ..... 211/36
2,973,867 A * 3/1961 Cohen ..... 211/37
3,425,564 A * 2/1969 Allsop ..... 211/37
3,788,241 A * 1/1974 Ravreby ..... 108/6
3,870,153 A * 3/1975 Allsop et al. ..... 211/37
3,958,695 A * 5/1976 Allsop et al. ..... 211/37
4,113,159 A * 9/1978 Allsop ..... 294/162
4,192,424 A * 3/1980 Allsop ..... 211/37
4,306,661 A * 12/1981 Allsop ..... 211/37
4,383,722 A * 5/1983 Weber ..... 312/324
5,269,419 A * 12/1993 Aldeguer et al. ..... 211/188
5,984,114 A * 11/1999 Frankel ..... 211/34
7,861,870 B2 * 1/2011 Chiang et al. ..... 211/37
2002/0027117 A1 * 3/2002 Brandenberg ..... 211/205
2005/0082244 A1 * 4/2005 Ho ..... 211/85.23
2009/0166303 A1 * 7/2009 Chiang ..... 211/37
2009/0211993 A1 * 8/2009 Chiang et al. ..... 211/37

* cited by examiner

*Primary Examiner* — Jennifer E. Novosad

(57) ABSTRACT

A shoe rack includes shoe support subassemblies each comprising a lower support including a rear hook, a sleeve passing through a rear end of the lower support and having a longitudinal first ridged section on an inner wall, an annular first projection extending inward from top of the first ridged section, and an annular second projection extending inward from an intermediate portion of the first ridged section; and an upper support including a hollow cylinder passing through a rear end of the upper support and having a longitudinal second ridged section on an outer surface, an annular first groove on top of the second ridged section, and an annular second groove on an intermediate portion of the second ridged section wherein the cylinder is inserted into the sleeve to be pivotably secured thereto; and a tube comprising slits each adapted to secure to the hook.

3 Claims, 13 Drawing Sheets

SHOE RACK

CROSS REFERENCE TO RELATED APPLICATIONS

This application is a divisional application of U.S. Ser. No. 12/037,947, filed Feb. 27, 2008 now U.S. Pat. No. 7,861,870, the contents of which are incorporated herein by reference.

BACKGROUND OF THE INVENTION

1. Field of Invention

The invention relates to shoe racks and more particularly to such a shoe rack having means adapted to adjust height between shoe supports of the same subassembly and being highly adaptable so as to fully utilize space.

2. Description of Related Art

Typically, pairs of shoes are stored in a shoe cabinet. The conventional shoe cabinet has a large storage space. Thus, the conventional shoe cabinet may occupy a large space of a room. Furthermore, internal space of the conventional shoe cabinet is divided into multiple tiers for storing shoes. However, these pairs of shoes may be different styles with different heights. The storage space of a tier is not effectively utilized if only pair of high-heeled shoes is stored therein with pairs of slippers being stored side by side in the remaining space. The conventional shoe racks also have the same drawback.

Thus the need for improvement still exists.

SUMMARY OF THE INVENTION

It is therefore one object of the invention to provide a shoe rack a plurality of shoe support subassemblies each comprising a lower support including a rear hook, a sleeve longitudinally passing through a rear end of the lower support and upward extending a predetermined distance, the sleeve having a longitudinal first ridged section on an inner wall thereof, an annular first projection extending inward from a top of the first ridged section, and an annular second projection extending inward from an intermediate portion of the first ridged section; and an upper support including a hollow cylinder longitudinally passing through a rear end of the upper support and downward extending a predetermined distance, the cylinder having a longitudinal second ridged section on an outer surface thereof, an annular first groove on a top of the second ridged section, and an annular second groove on an intermediate portion of the second ridged section wherein the cylinder is dimensioned to insert into the sleeve to be pivotably frictionally secured thereto by cooperatively (i) engaging the first groove with the first projection and the second groove with the second projection respectively or (ii) engaging the second groove with the first projection; and a tube comprising a plurality of slits (321) each adapted to secure to the inserted hook.

The above and other objects, features and advantages of the invention will become apparent from the following detailed description taken with the accompanying drawings.

DETAILED DESCRIPTION OF THE INVENTION

Figure 1:
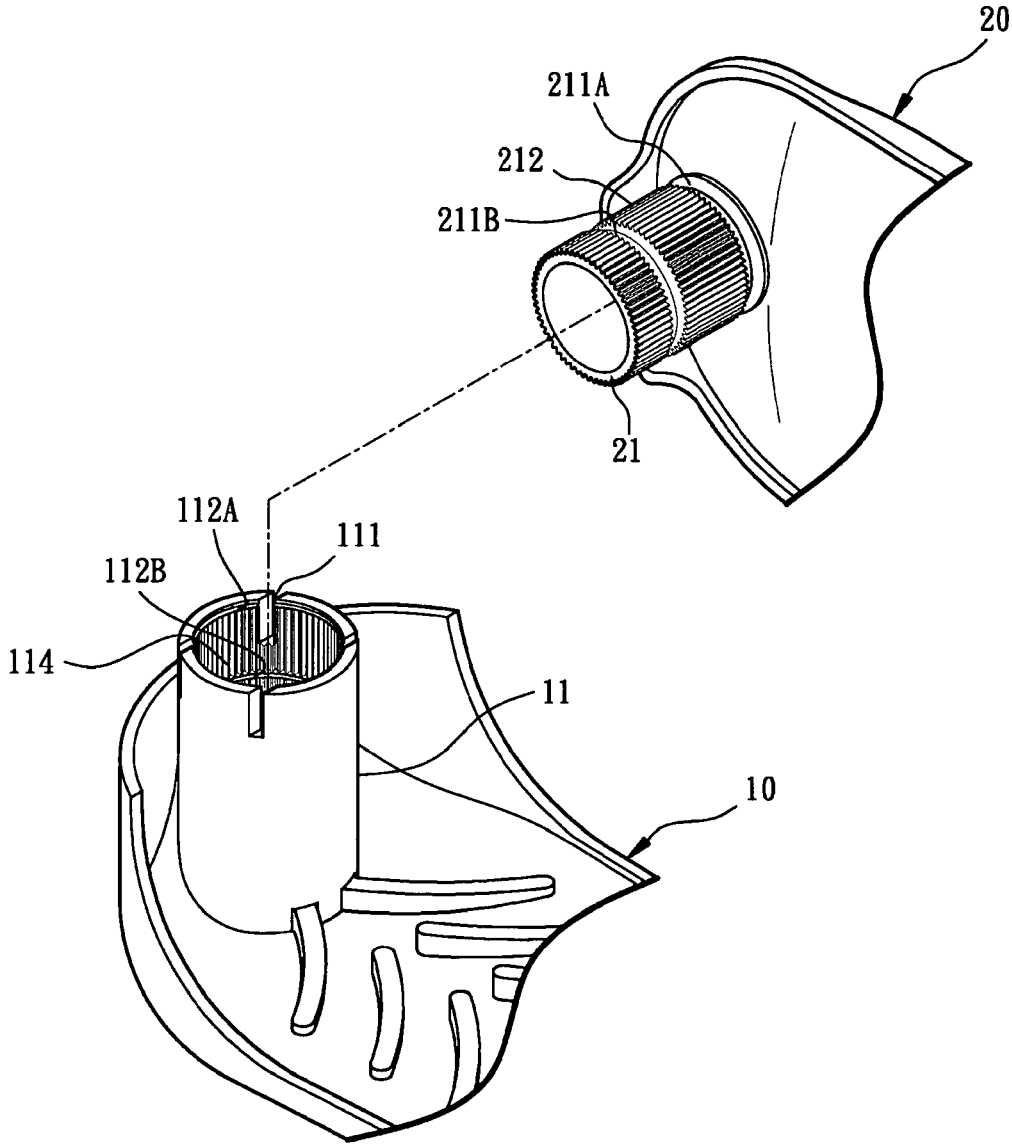
FIG. 1 is an exploded view of a shoe support subassembly according to a first preferred embodiment of the invention.
Figure 3:
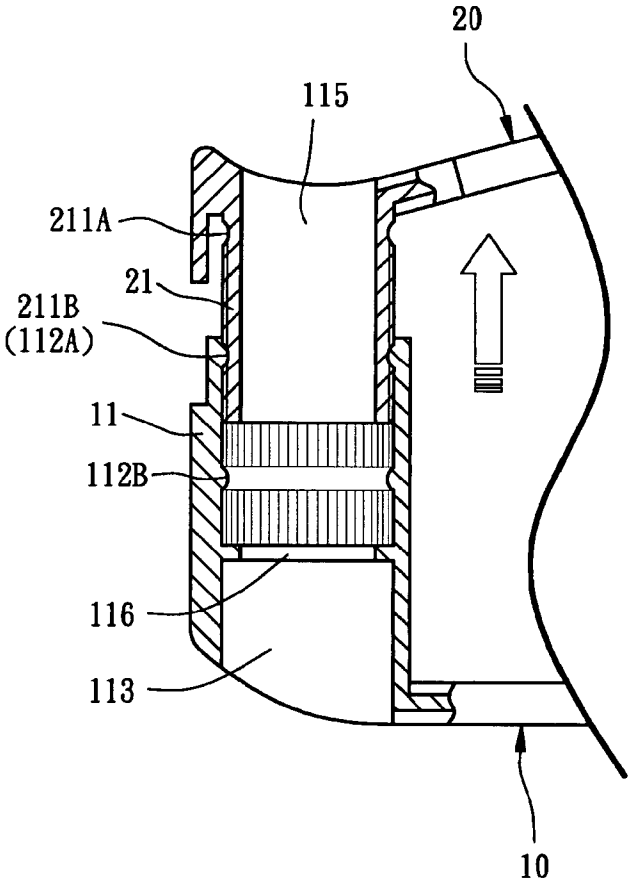
FIG. 3 is a view similar to FIG. 2 where the distance is greater than that shown in FIG. 2 after adjusting.
Figure 2:
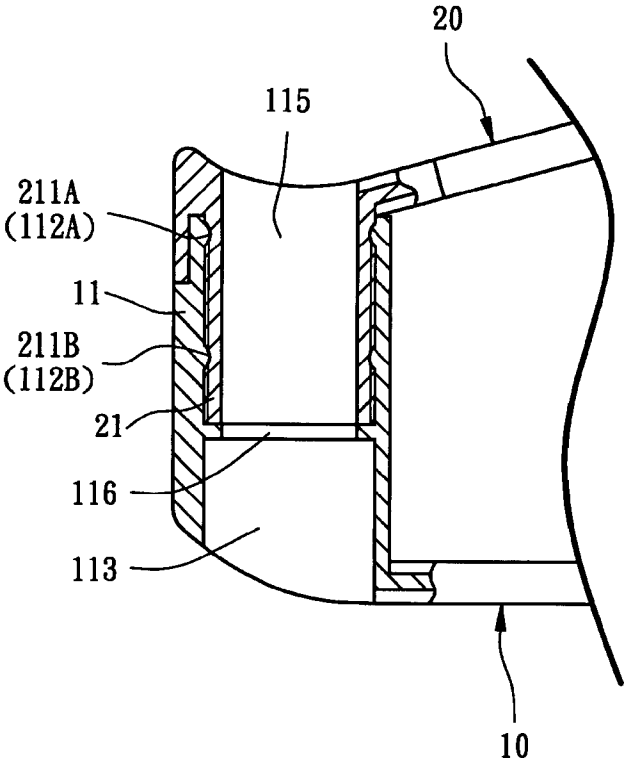
FIG. 2 is a side elevation in part section of the shoe support subassembly where a distance between the lower support and the upper support is a minimum.

Referring to FIGS. 1 to 3, a shoe support subassembly according to a first preferred embodiment of the invention is shown. The shoe support subassembly comprises a lower support 10 and an upper support 20. Each component is discussed in detail below.

The lower support 10 is substantially shaped as a sole and comprises a sleeve longitudinally passing through a rear portion and upward extending a predetermined distance. A channel 116 of reduced diameter is provided to divide an internal space of the sleeve 11 into a lower space 113 and an upper space 115 in communication with the lower space 113. An inner wall of the upper space 115 is formed with a longitudinal ridged section 114. A plurality of longitudinal slits 111 are formed on an upper portion of the sleeve 11 so as to make the upper portion flexible. An annular upper projection 112A is formed around the mouth of the upper space 115 and extends inwards. An annular lower projection 112B is formed around an intermediate portion of the inner wall of the upper portion of the sleeve 11.

The upper support 20 is also substantially shaped as a sole and is inclined toward its rear. The upper support 20 comprises a hollow cylinder 21 longitudinally passing through a rear portion and downward extending a predetermined distance. An outer surface of the cylinder 21 is formed with a longitudinal ridged section 212. An annular upper groove 211A is formed at a joining point of the cylinder 21 and the inclined section of the upper support 20. An annular lower groove 211B is formed around an intermediate portion of the outer surface of the cylinder 21.

The cylinder 21 has an outer diameter substantially the same as an inner diameter of the sleeve 11. Thus, the cylinder 21 is adapted to fully insert into the sleeve 11 to be pivotably frictionally secured thereto by matingly engaging the upper groove 211A with the upper projection 112A and the lower groove 211B with the lower projection 112B respectively (see FIG. 2). Further, a distance between the lower support 10 and the upper support 20 as shown in FIG. 2 can be adjusted depending on applications by pulling the upper support 20 upward to engage the lower groove 211B with the upper projection 112A (see FIG. 3).

Figure 4:
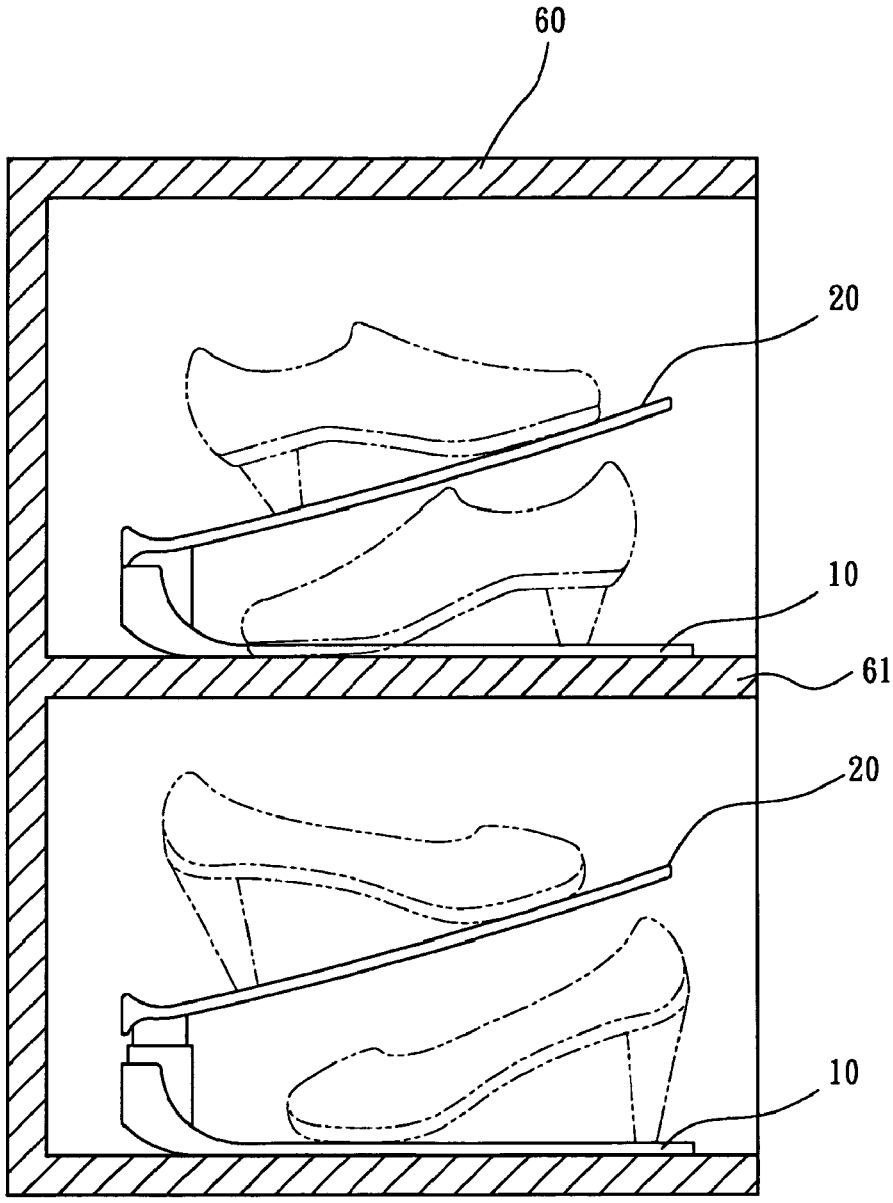
FIG. 4 is a longitudinal sectional view of a shoe cabinet having an upper compartment mounted with at least one shoe support subassembly having two shoes supported thereon, and a lower compartment mounted with at least one shoe support subassembly having two shoes supported thereon as a first configuration of the first preferred embodiment of the invention.
Figure 5:
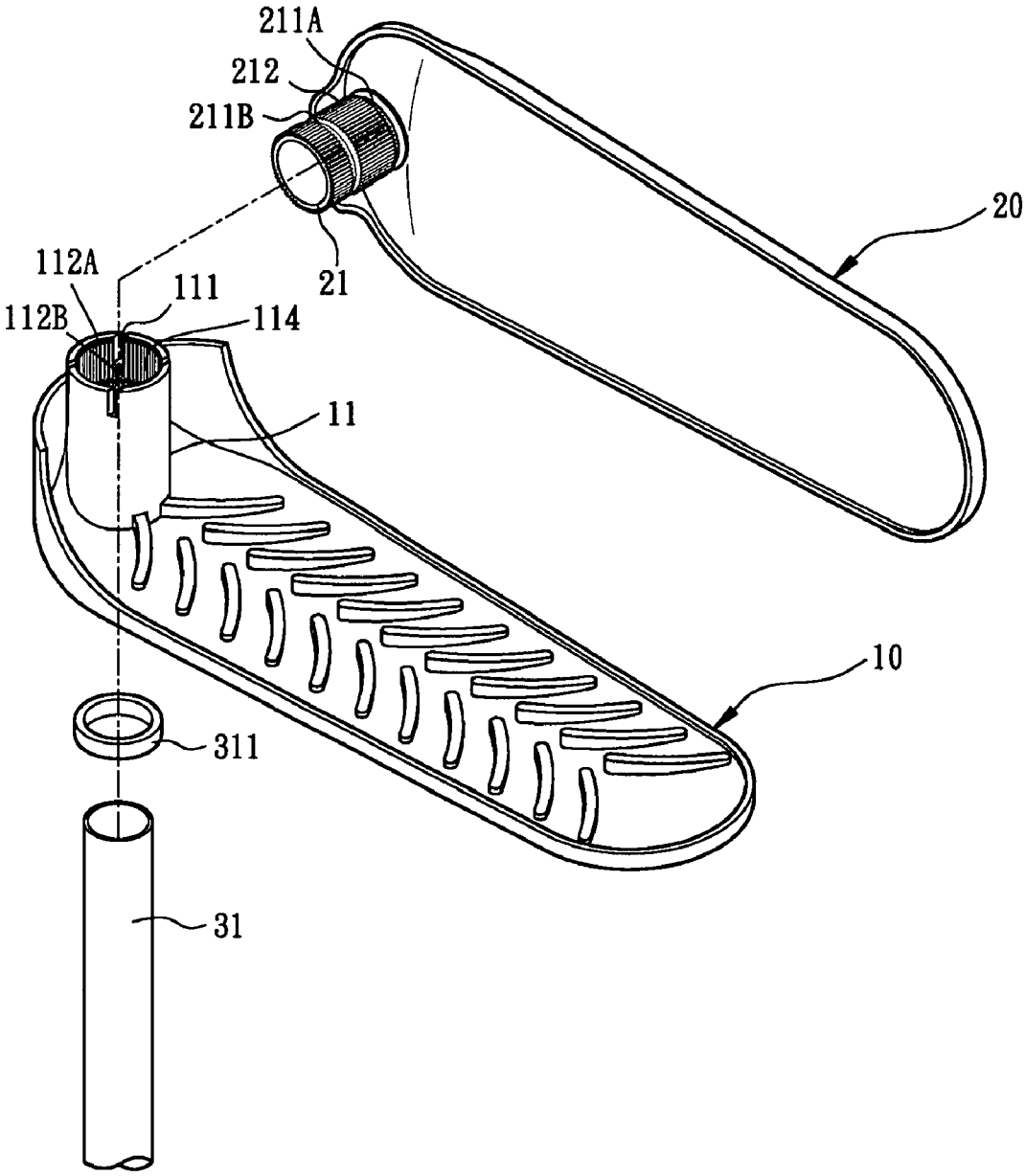
FIG. 5 is an exploded view of the shoe support subassembly where the lower support and the upper support of the shoe support subassembly, as one of a plurality of such shoe support subassemblies, are to be assembled on a tube of circular section as a second configuration of the first preferred embodiment of the invention.
Figure 6:
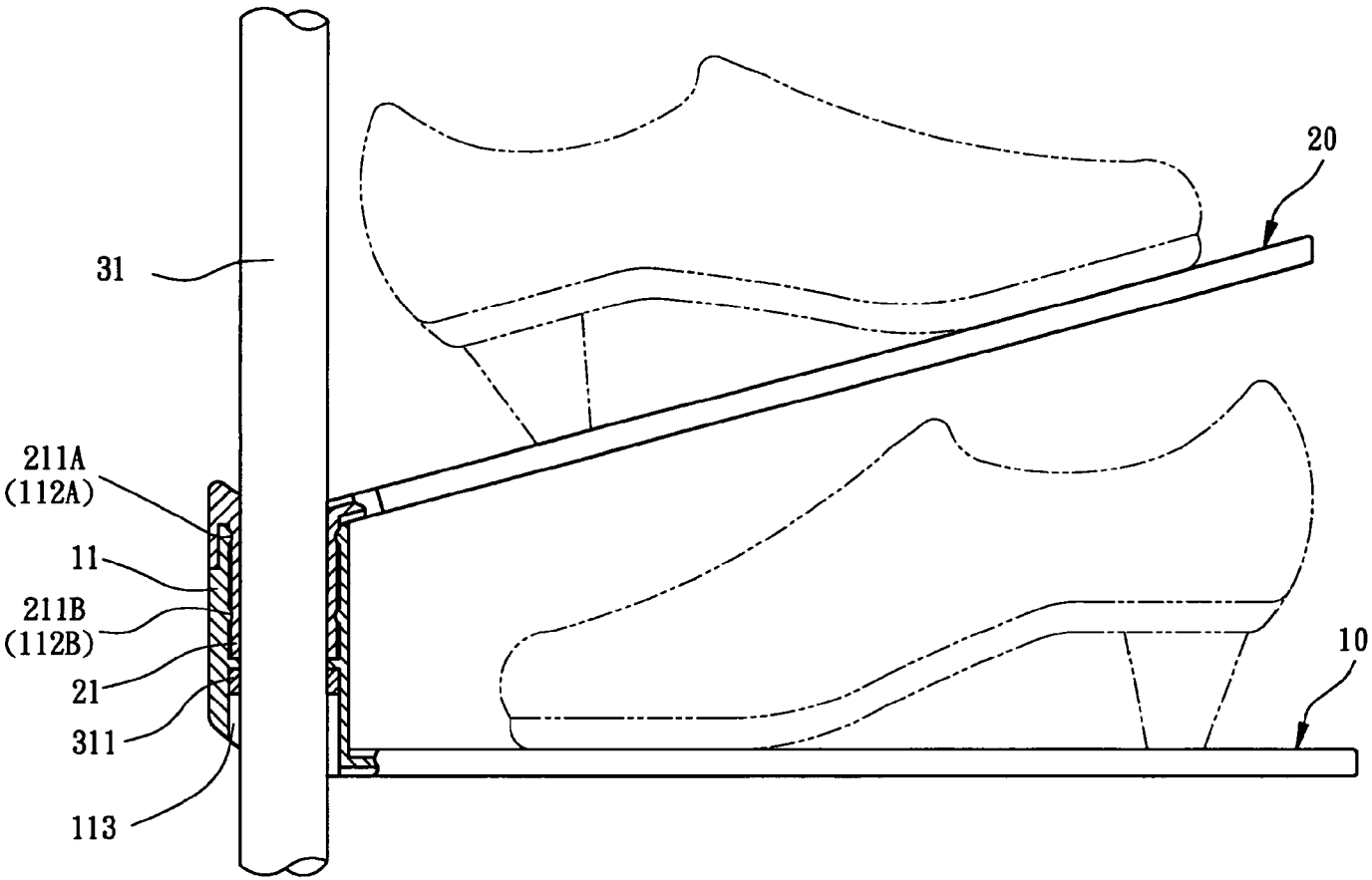
FIG. 6 is a side elevation in part section of the shoe support subassembly and the tube shown in FIG. 5 where a distance between the lower support and the upper support is a minimum.
Figure 7:
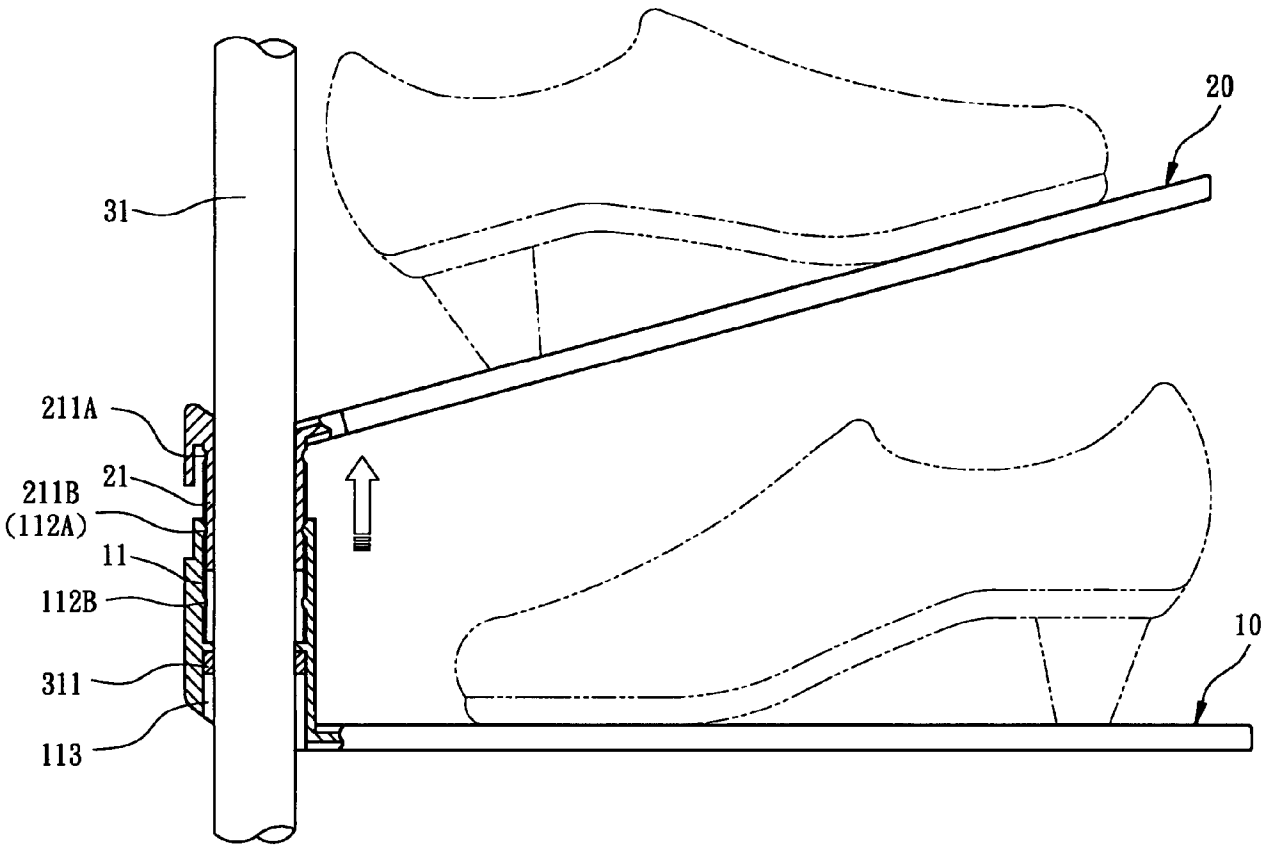
FIG. 7 is a view similar to FIG. 6 where the distance is greater than that shown in FIG. 2 after adjusting.

Referring to FIG. 4, there is shown a shoe cabinet 60 having a shelf 61 for dividing an internal space thereof into an upper compartment mounted with at least one shoe support subassembly (only one is shown) having two shoes supported on the lower support 10 and the upper support 20 respectively, and a lower compartment with at least one shoe support subassembly (only one is shown) having two shoes supported on the lower support 10 and the upper support 20 respectively as a first configuration of the first preferred embodiment of the invention.

Referring to FIGS. 5 to 9, a second configuration of the first preferred embodiment of the invention is shown and its characteristics are detailed below. A tube 31 of circular section has an outer diameter substantially the same as an inner diameter of the channel 116 and the inner diameter of the cylinder 21. Also, a flexible ring 311 is adapted to put on the tube 31. Thus, the tube 31 is adapted to pass through the sleeve 11 and the cylinder 21 and the flexible ring 311 is urged against the bottom of the channel 116. The provision of the flexible ring 311 is to enhance the frictional fastening of the lower support 10 and the upper support 20 with the tube 31. In addition to the feature of adjusting a distance between the lower support 10 and the upper support 20 as described above and the shoe support subassemblies being adapted to assemble as longitudinally aligned ones (see a stand 30 of FIG. 8), any shoe support subassembly is adapted to orient about 90 degrees with respect to an adjacent one by frictionally pivoting itself about the tube 31 when the shoe rack is disposed on a room corner (see FIG. 9). This can reserve space for storing larger shoes on the upper supports 20 when such need arises.

Figure 8:
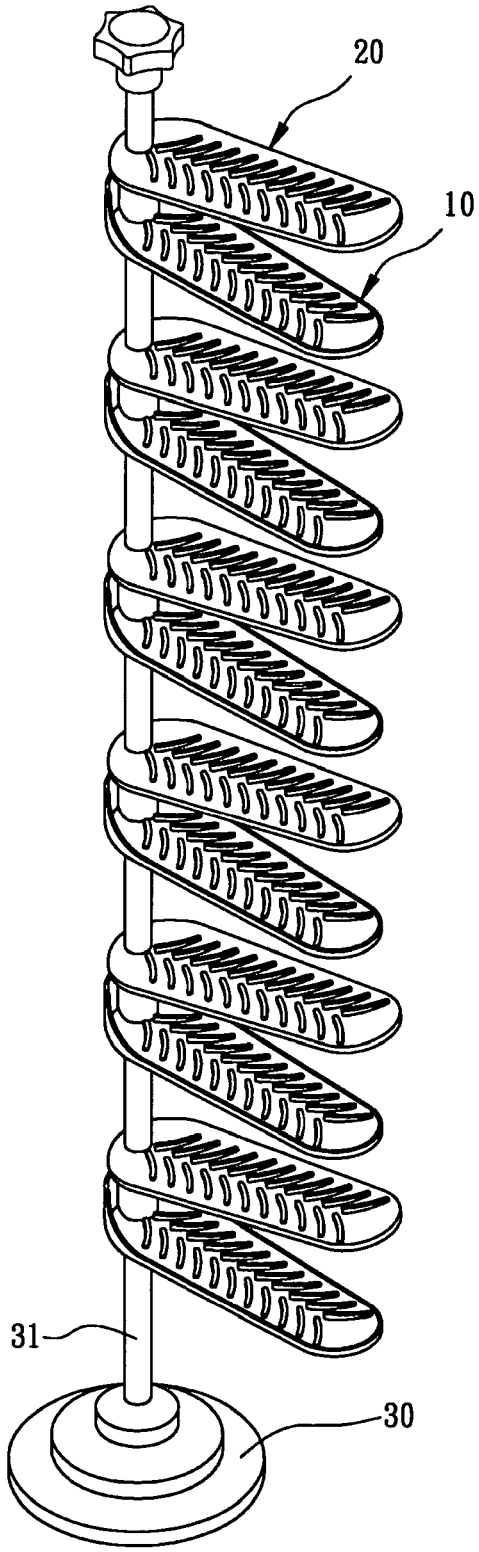
FIG. 8 is a perspective view of a shoe rack assembled as a stand according to the second configuration of the first preferred embodiment of the invention where the shoe support subassemblies are longitudinally aligned.
Figure 9:
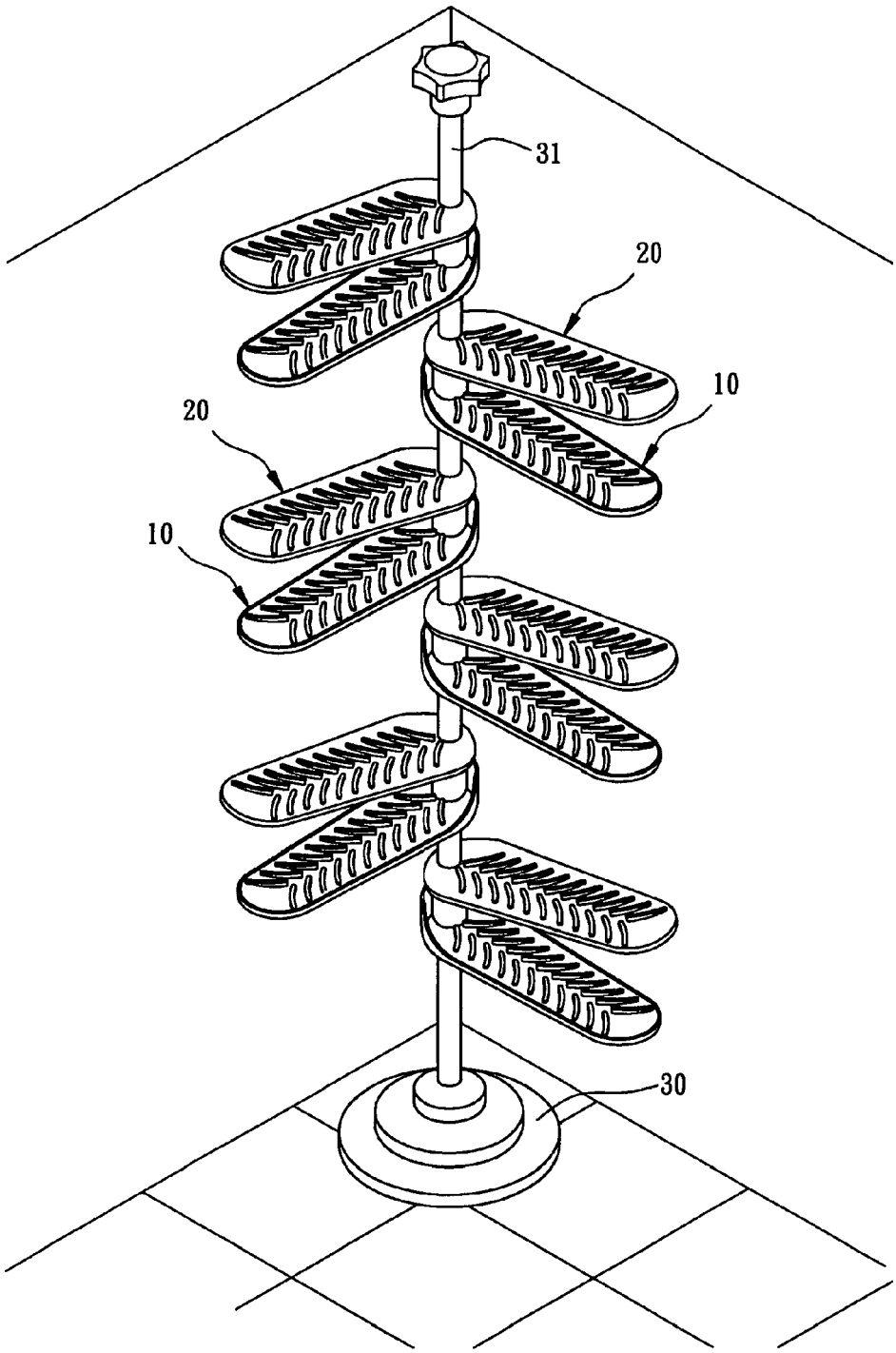
FIG. 9 is a view similar to FIG. 8 where any shoe support subassembly is oriented about 90 degrees with respect to an adjacent one when the shoe rack is disposed on a room corner.
Figure 10:
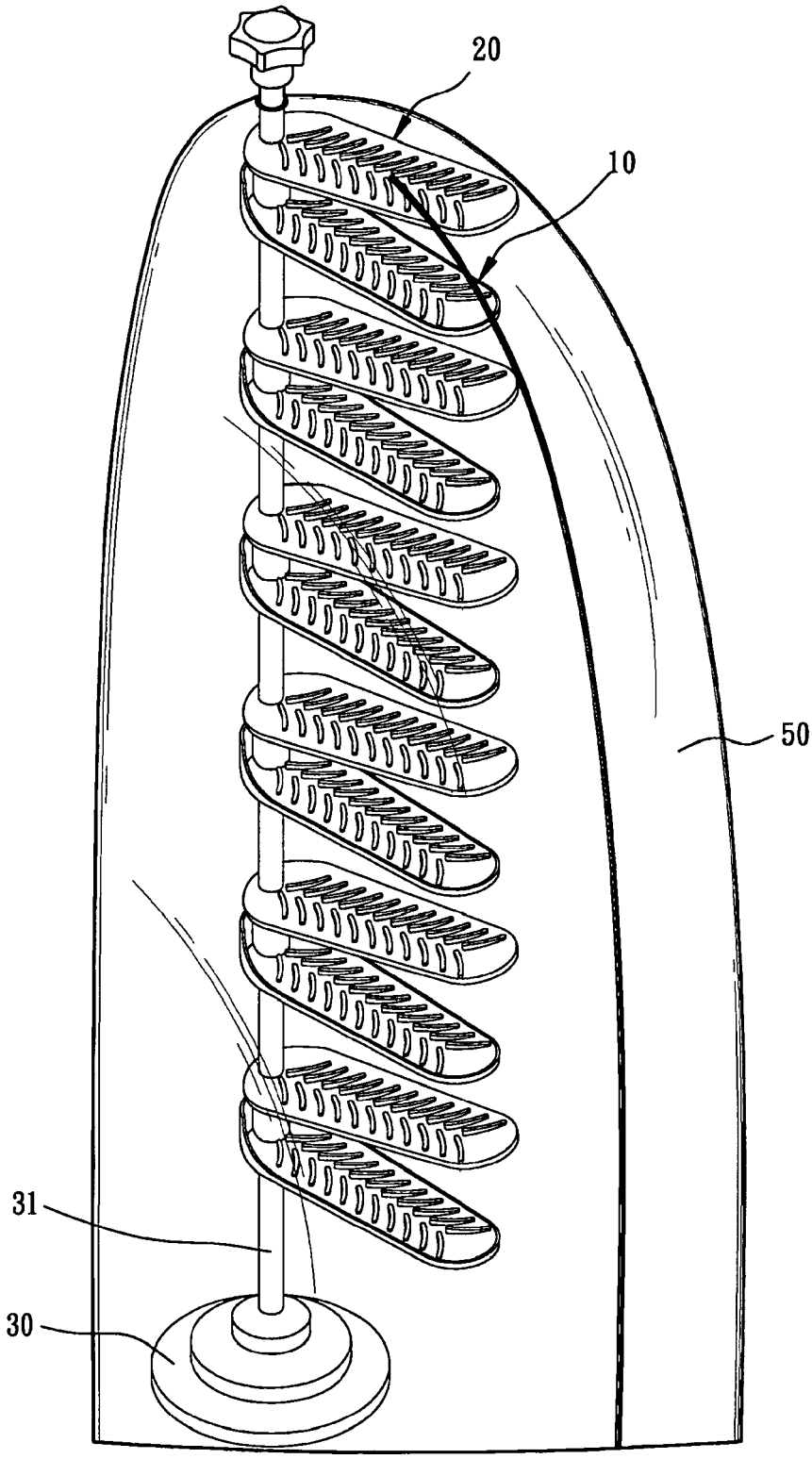
FIG. 10 is a perspective view of the shoe rack shown in FIG. 8 where a transparent dust cover is mounted therearound according to a third configuration of the first preferred embodiment of the invention.

Referring to FIG. 10, the shoe rack shown in FIG. 8 is additionally provided with a zipped transparent dust cover 50 therearound according to a third configuration of the first preferred embodiment of the invention.

Figure 11:
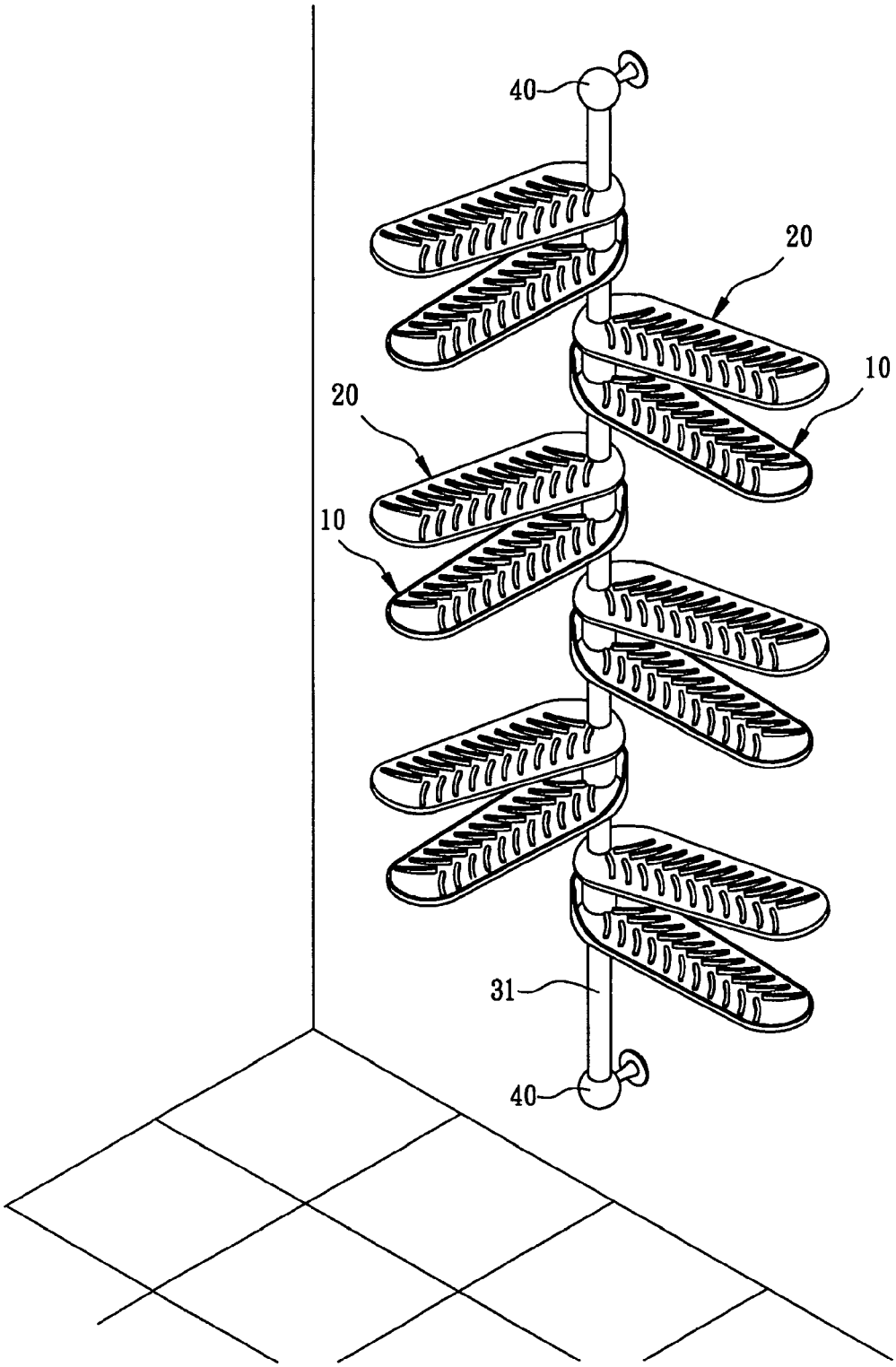
FIG. 11 is a perspective view of a wall mounted shoe rack according to a fourth configuration of the first preferred embodiment of the invention.

Referring to FIG. 11, two rounded enlarged members 40 each is formed at either top or bottom end of the tube 31. Also, each rounded enlarged member 40 extends laterally to be secured to a wall. This wall mounted shoe rack is according to a fourth configuration of the first preferred embodiment of the invention.

Figure 12:
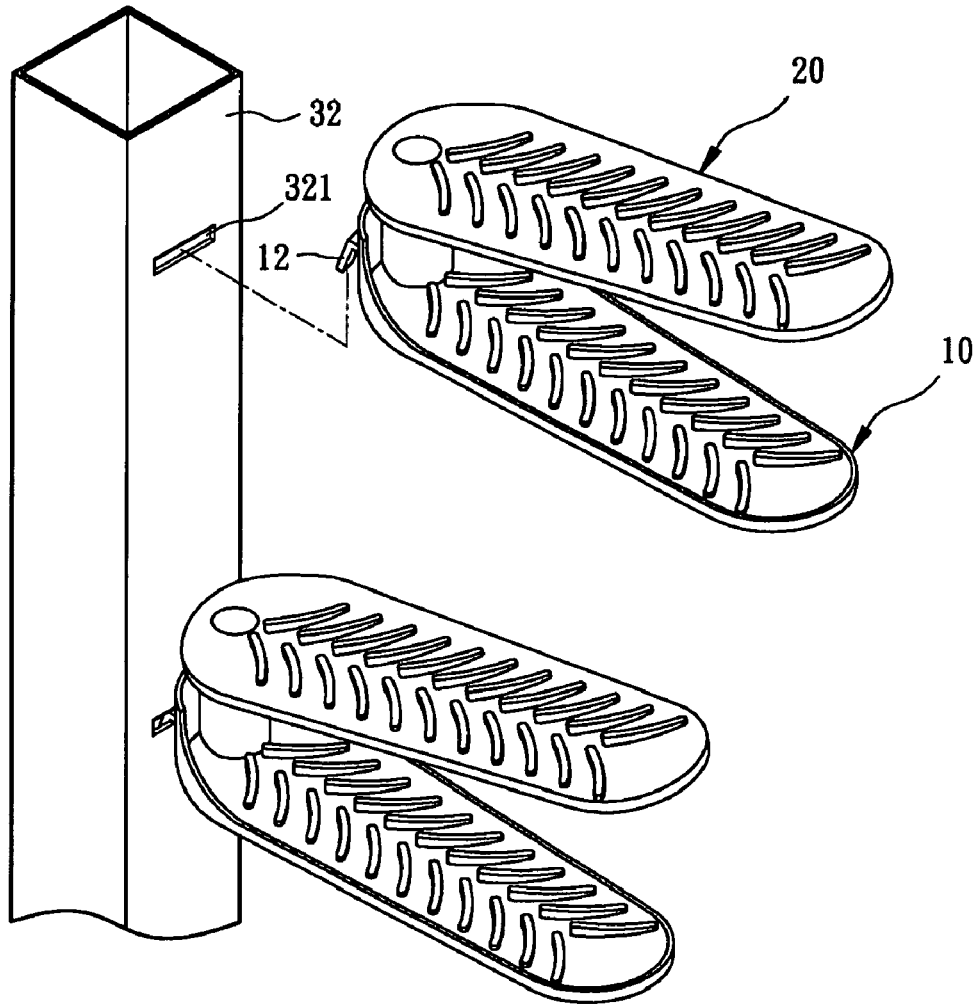
FIG. 12 is an exploded perspective view of a portion of a shoe rack where one shoe support subassembly has been mounted on a tube of rectangular section and the other shoe support subassembly is to be assembled thereon according to a second preferred embodiment of the invention.
Figure 13:
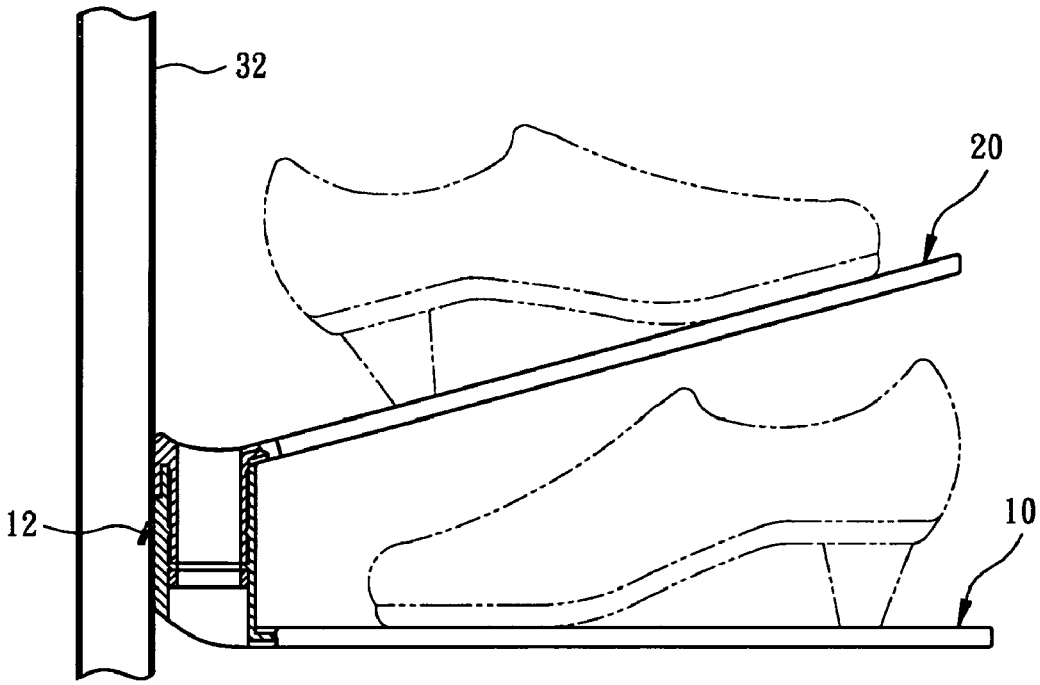
FIG. 13 is a side view in part section of the lower shoe support subassembly shown in FIG. 12 with two shoes being supported thereon.

Referring to FIGS. 12 and 13 in conjunction with FIGS. 1 to 3, a second preferred embodiment of the invention is shown. The characteristics of the second preferred embodiment are detailed below.

The pole 31 is eliminated. The shoe rack comprises a tube 32 of rectangular section. A plurality of horizontal slits 321 are formed along one surface of the tube 32. A hook 12 is formed on the rear end of the lower support 10. The hook 12 is adapted to insert into the slit 321 to mount the shoe support subassembly on the tube 32.

Figure 14:
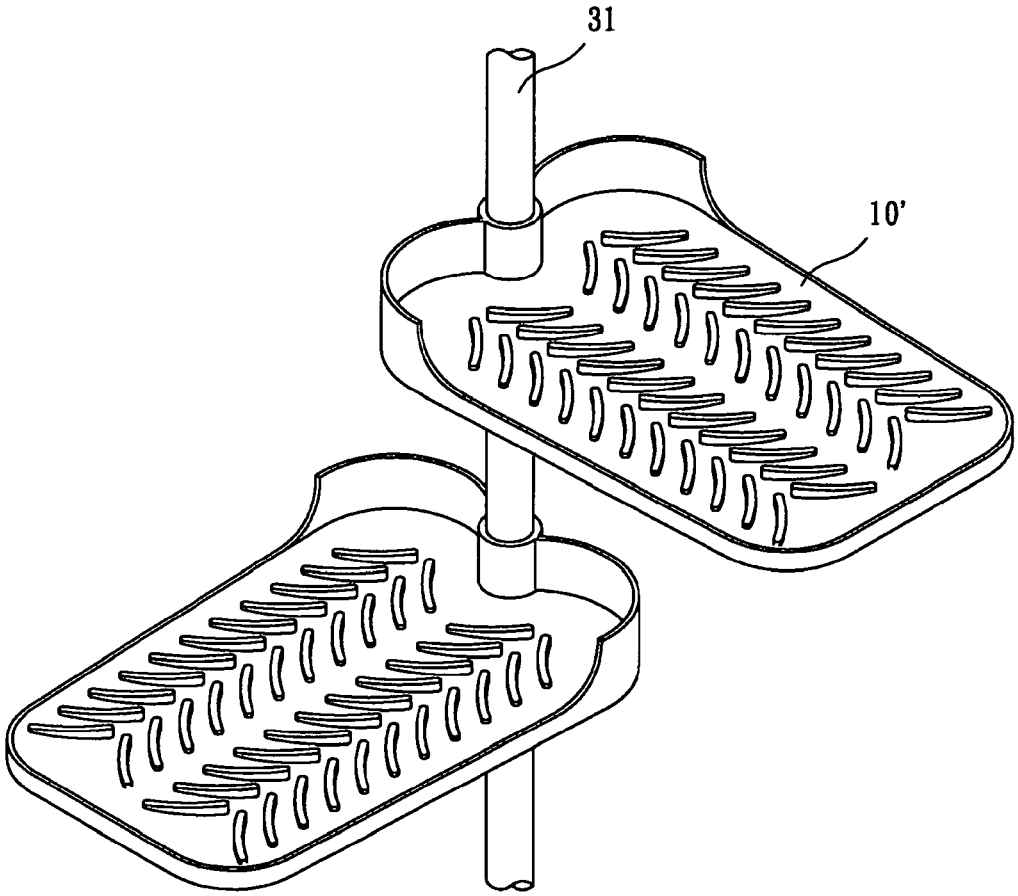
FIG. 14 is a perspective view of a portion of a shoe rack assembled as a stand according to a third preferred embodiment of the invention.

Referring to FIG. 14, a third preferred embodiment of the invention is shown. The characteristics of the third preferred embodiment are detailed below. The upper supports 20 are eliminated and each lower support 10' may support a pair of shoes (not shown).

While the invention has been described in terms of preferred embodiments, those skilled in the art will recognize that the invention can be practiced with modifications within the spirit and scope of the appended claims.

What is claimed is:

1. A shoe rack comprising:

a plurality of shoe support subassemblies each comprising:

a lower support (10) including a rear hook (12), a sleeve (11) longitudinally passing through a rear end of the lower support (10) and upward extending a predetermined distance, the sleeve (11) having a longitudinal first ridged section (114) on an inner wall thereof, an annular first projection (112A) extending inward from a top of the first ridged section (114), and an annular second projection (112B) extending inward from an intermediate portion of the first ridged section (114); and an upper support (20) including a hollow cylinder (21) longitudinally passing through a rear end of the upper support (20) and downward extending a predetermined distance, the cylinder (21) having a longitudinal second ridged section (212) on an outer surface thereof, an annular first groove (211A) on a top of the second ridged section (212), and an annular second groove (211B) on an intermediate portion of the second ridged section (212) wherein the cylinder (21) is dimensioned to insert into the sleeve (11) to be pivotably frictionally secured thereto by cooperatively (i) engaging the first groove (211A) with the first projection (112A) and the second groove (211B) with the second projection (112B) respectively or (ii) engaging the second groove (211B) with the first projection (112A); and a tube (32) comprising a plurality of slits (321) each adapted to secure to the inserted hook (12).

2. The shoe rack of claim 1, wherein the upper support (20) is inclined toward its rear end.

3. The shoe rack of claim 1, wherein an upper portion of the sleeve (11) is latched.

* * * * *